US005472054A

United States Patent [19]

Hinds

[11] Patent Number: 5,472,054

[45] Date of Patent: Dec. 5, 1995

[54] FREE PUMPING APPARTUS SAFETY VALVE SYSTEM AND METHOD

[76] Inventor: Arron C. Hinds, 801 E. Nasa Rd. 1 #3004, Webster, Tex. 77598

[21] Appl. No.: 386,070

[22] Filed: Feb. 9, 1995

[51] Int. Cl.[6] ..... E21B 34/08; E21B 34/14; E21B 43/12

[52] U.S. Cl. ..... 166/373; 166/106; 166/332.5; 166/381; 166/386

[58] Field of Search ..... 166/373, 332, 166/106, 381, 386, 68; 417/170, 172, 151, 448

[56] References Cited

U.S. PATENT DOCUMENTS

| | | | |
|---|---|---|---|
| 1,355,606 | 10/1920 | Ingram | 166/68 |
| 1,758,376 | 5/1930 | Sawyer | 166/32 |
| 2,287,076 | 6/1942 | Zachry | 417/108 |
| 2,826,994 | 3/1958 | Slater | 417/108 |
| 3,215,087 | 11/1965 | McLeod | 166/267 X |
| 3,887,008 | 6/1975 | Canfield | 166/267 |
| 4,183,722 | 1/1980 | Roeder | 417/172 |
| 4,293,283 | 10/1981 | Roeder | 417/172 |
| 4,390,061 | 6/1983 | Short | 166/53 |
| 4,440,231 | 4/1984 | Martin | 166/332 X |
| 4,603,735 | 8/1986 | Black | 166/68 |
| 4,625,798 | 12/1986 | Bayh, III | 166/106 |
| 4,641,707 | 2/1987 | Akkerman | 166/332 X |
| 4,790,376 | 12/1988 | Weeks | 166/68 |
| 5,083,609 | 1/1992 | Coleman | 166/68 |

*Primary Examiner*—Stephen J. Novosad
*Attorney, Agent, or Firm*—Keeling Law Firm

[57] ABSTRACT

A free pumping apparatus safety valve system for use in producing a formation fluid source that mounts to the bottom end of a tubing within the well bore fluid communication conduit of a producing well. The free pumping apparatus has two main parts, the pump housing and the pump body. A longitudinal passageway in the pump housing slidably and operatively receives the pump body. The size and construction of the pump body facilitates placement of the pump body into an upper end of an installed tubing and sliding conveyance of the pump body through the tubing and into the pump housing longitudinal passageway. Within the longitudinal passageway proximal the lower end of the passageway, a valve plate selectively mates with a valve seat to seal a valve opening. The valve plate is biased to a closed position by a torsional spring. When the pump body is in a fully-inserted position within the pump housing, a plunger attached to the lower end of the pump body actuates the valve plate to an opened position. A freely floating ball check valve permits the downstream flow of power fluid through a cavity in the pump body but prohibits reverse upstream flow through the cavity. Functionally applying the above mentioned valves provides an exceptionally responsive safety shut-off method to prevent the loss of formation fluids. A safety valve mounted below the pump housing prevents flow of fluids from the housing into the formation fluid source.

13 Claims, 3 Drawing Sheets

FREE PUMPING APPARTUS SAFETY VALVE SYSTEM AND METHOD

BACKGROUND OF THE INVENTION

1. Field of the Invention

This invention relates to a "free" pumping apparatus safety valve system. More specifically, it is directed to an improved, free pumping apparatus safety valve system for use in producing a formation fluid that provides a safety valve and a recirculation valve.

Presently, the need for natural gas and oil is increasing without a proportionate rise in price. Therefore, to remain competitive, companies must continuously become more efficient in their recovery of these resources.

In general, a well includes a well casing that is perforated within the formation. The well casing has a longitudinal passageway that provides flow communication with the surface for recovery of formation fluids. Other possible well configurations include a well tubing mounted within a well casing wherein the well tubing provides the flow communication to the surface. In addition, the well tubing may extend below the well casing in an open hole configuration. Because of the prolificacy of well configurations, the well casing and, if applicable, well tubing are hereinafter referred to generally as a well bore fluid communication conduit.

A number of pumps are used to aid recovery of the formation fluids. Devices proven to provide efficient recovery of formation fluids, such as natural gas and oil, are downhole jet pumps and downhole reciprocating pumps. These downhole pumps are mounted in the bottom of the well bore fluid communication conduit below the formation fluid level. A hollow tubing, either conventional tubing or coil tubing, within the well bore fluid communication conduit provides fluid communication between the surface and the pump's power fluid inlet.

Certain of these pumps are "free," or capable of recirculation from the bottom of the tubing. A free pump is made of two separate main parts. The first part is the housing which is fixedly mounted to the lower end of the tubing. The second part is the pump body which has a small diameter and contains a number of the pump parts that are typically subject to wear or blockage. When the pump body is inserted in an upper end of the tubing and a power fluid is then transmitted therethrough, the pump body's compact design permits it to travel through the tubing to the tubing's lower end. The housing is designed to slidably, removably, and operatively receive the pump body. Once in the housing, the pump body and housing form the jet pump which may then commence operation.

To provide for low cost maintenance of the pump body parts, removal of the pump body is easily accomplished by reversing the flow through the system, or pumping fluid downwardly through the well bore fluid communication conduit and receiving it upwardly through the tubing. In this way, the pump body slides from the housing and up through the tubing.

Present pump bodies, however, have power fluid inlets that remain open even during recirculation of the pump body out of the tubing. Thus, the recirculating fluid has a relatively small area on which to force the pump body upward and a substantial amount of the recirculated fluid simply flows through the pump body. Consequently, the energy required to recirculate the fluid that simply passes through the power fluid inlet is wasted. Also, because power fluid inlets remain open during recirculation, the pump body is relatively less responsive to recirculated flow than if the power fluid inlets were closed.

A great proportion of the producing natural gas and oil reserves are located offshore. To protect the sensitive oceanic environment, offshore oil wells must meet strict environmental and safety regulatory requirements. One such requirement, is that the well provide a safety valve so that, in the event of damage to the well bore fluid communication conduit, and subsequent loss of power fluid pressure, formation pressure will not force formation fluids into the ocean and, thereby, cause environmental harm. Currently, free pumps do not meet this requirement and cannot be used in offshore wells. Once positioned in the pump housing, the pressure supplied by the power fluid maintains the pump body in the pump housing. In high volume producing formations, the formation fluid is under pressure and, thus, exerts an upward force on the pump body. Consequently, the downward pressure supplied by the power fluid must be greater than the upward force of the formation fluid. When the well bore fluid communication conduit or the tubing is damaged, the power fluid cannot supply the downward pressure required to maintain the pump body in the pump housing. Thus, the formation fluid forces the pump body from the pump housing. Depending upon the amount of pressure supplied by the formation and the location of the damage to the well bore fluid communication conduit, the formation fluid may escape from the well bore fluid communication conduit.

2. Related Art

Free pumps and other formation fluid recovery devices have long been known to the prior art. Illustrative of such devices are U.S. Pat. Nos. 1,355,606; 1,758,376; 2,287,076; 2,826,994; 3,215,087; 3,887,008; 4,183,722; 4,293,283; 4,390,061; 4,603,735; 4,790,376; and 4,083,609.

None of the above mentioned references disclose a free pump that provides a safety valve system that stops flow from the well formation to the well bore fluid communication conduit and tubing when the flow of power fluid is interrupted. Nor do these references disclose a check valve within the pump body to provide for more responsive and more efficient pump body removal.

SUMMARY OF THE INVENTION

Accordingly, the objectives of this invention are to provide, inter alia, a free pumping apparatus safety valve system for producing a formation fluid source that:

- permits efficient production of formation fluid;
- provides a housing that attaches to the bottom end of a well tubing;
- allows slidable, removable placement of the pump body within the housing by circulating the pump body down through the tubing and into operative engagement with the housing;
- permits recirculation of a pump body from the tubing;
- provides a check valve within the pump body that closes during recirculation for a more responsive and efficient recirculation of the pump body;
- incorporates a safety valve to prevent the escape of formation fluids when the well bore fluid communication conduit or tubing is damaged or the power fluid flow is otherwise interrupted;
- utilizes a plunger on the pump body to actuate the safety valve; and
- utilizes a check valve within the pump body that closes when exposed to escaping formation fluid and, thereby, allows for more sensitive, responsive safety valve operation.

To achieve such improvements, my invention is a free pumping apparatus safety valve system for producing a formation fluid that provides a safety valve system to prevent escape of formation fluid when the power fluid supply is interrupted. The free pumping apparatus has two main parts, a housing and a pump body. The housing has a longitudinal passageway constructed to removably, slidably receive the pump body. A housing upper end of the housing has an attachment means for connecting the housing to a tubing bottom end.

The pump body is small enough that it is able to travel through a longitudinal cavity in the tubing and into operable engagement with the pump housing. Once positioned in the pump housing, the pressure supplied by the power fluid maintains the pump body in the pump housing. In high volume producing formations, the formation fluid is under pressure and, thus, exerts an upward force on the pump body. Consequently, the downward pressure supplied by the power fluid must be greater than the upward force of the formation fluid. Without appropriate safety devices, insufficient power fluid pressure permits reverse flow of formation fluids through the free pumping apparatus.

At an upper end of the pump body, at least one power fluid inlet provides fluid communication between a pump body cavity and the tubing cavity. Within the pump body cavity, a check valve means selectively permits flow through the power fluid inlet and the pump body cavity. The check valve means permits flow through the power fluid inlet and the cavity during operative fluid production flow and restricts the flow during reverse circulating flow.

Preferably, the check valve means comprises a valve ball positioned in the pump body cavity. The valve ball is sized and constructed such that it is free to move vertically within a check valve portion of the pump body cavity defined by a valve seat at the upper end of the check valve portion and by a flow-through valve ball holder at the lower end of the check valve portion. To accomplish the free movement of the valve ball within the check valve portion, the valve ball must have a diameter less than the diameter of the check valve portion pump body cavity.

To facilitate restriction of the flow during reverse circulating flow, the valve seat sealingly mates with the valve ball during reverse circulating flow. In the preferred embodiment, the valve seat comprises a frustoconical shaped portion of the pump body cavity that increases in diameter in a downstream direction, defined by the direction of flow during operative fluid production flow. To accommodate sealing engagement of the valve ball and the valve seat, the diameter of the frustoconical portion smaller diameter end is smaller than the valve ball diameter end.

Likewise, to facilitate flow through the pump body cavity during operative fluid production flow, the flow-through valve ball holder in the pump body cavity receives the valve ball during operative fluid production flow and, when so engaged, permits flow therethrough. At the top end of the flow-through valve ball holder, the valve ball engagement end receives and mates with the valve ball. At least one communication passageway formed in the pump body cavity maintains flow communication between the valve ball engagement end and a distal lower end downstream of the valve ball engagement end.

Functionally applying the free pumping apparatus including the check valve means described above to a tubing positioned within a well bore fluid communication conduit and reverse circulating a fluid downwardly through the well bore fluid communication conduit and up through the tubing provides a method of improved reverse circulation of a pump body from the housing and out through the connected tubing. During the reverse circulating flow, the check valve closes the pump body cavity and provides a greater surface area on which the reverse circulation flow may act. Thus, the check valve provides for greater efficiency, response, and sensitivity in reverse circulation removal of the pump body. The check valve also prevents flow through the pump body cavity in response to the reverse flow of formation fluids through the pump body. In such cases, the pressure of the formation fluids forces the pump body from the pump housing with greater efficiency, responsiveness, and sensitivity because the formation fluid has a greater surface area on which to act.

Proximal the lower end of the pump housing within the pump housing passageway, a valve means selectively permits the flow of formation fluid therethrough. In the preferred embodiment, the valve means comprises a valve opening constructed to allow the flow of formation fluid therethrough. Disposed about a valve opening, a valve seat selectively, sealingly mates with a valve plate. Thus, when the valve plate is in sealing engagement with the valve seat the flow through the valve opening is stopped and the valve opening is closed. However, a hinge rotatably connects the valve plate to the pump housing. Consequently, a force on the upper face of the valve plate will rotate the valve plate to an open position and allow the flow of formation fluid through the valve opening. A biasing means influences the valve plate to a closed position. Therefore, to force the valve plate to an open position requires a force greater than the closing force supplied by the biasing means.

A plunger connected to the lower end of the pump body selectively opens and closes the valve means. During normal operation of the free pumping apparatus, the constant downward force on the pump body by the power fluid maintains the pump body in a predetermined fully-inserted position within the pump housing. When in this fully-inserted position, the plunger forces the valve plate off of the valve seat and, thereby, opens the valve opening.

As mentioned, the pump body is slidably removable from the pump housing by either reverse circulation flow or by reverse flow of the formation fluid. If the pump body is forced out of the fully-inserted position by either of these reverse flows, the plunger no longer provides the required force on the valve plate to open the valve opening and the valve plate closes the valve opening.

Functionally applying the apparatus mentioned above provides a method of preventing the escape of formation fluid from a damaged producing formation. Applying the check valve means to a free pumping apparatus having the safety valve means provides for a more responsive pump body and, thereby, increases the effectiveness of the safety valve means. In other words, because the safety valve is actuated by the upward movement of the pump body, the safety valve becomes more responsive and effective when the pump body becomes more responsive to the reverse flow of the formation fluid. Providing a more responsive safety valve, reduces the waste of formation fluid in the event of damage to the well bore fluid communication conduit or the tubing.

A standing valve proximal the housing lower end of the pump housing allows formation fluid flow upward into the pump housing but prohibits downward flow out of the pump housing lower end.

BRIEF DESCRIPTION OF THE DRAWING

The manner in which these objectives and other desirable characteristics can be obtained is explained in the following description and attached drawings in which.

DETAILED DESCRIPTION OF THE INVENTION

The preferred embodiment of my invention is illustrated in FIGS. 1 through 7 and the free pumping apparatus safety valve system for use in producing a formation fluid source is depicted as 10.

Figure 1:
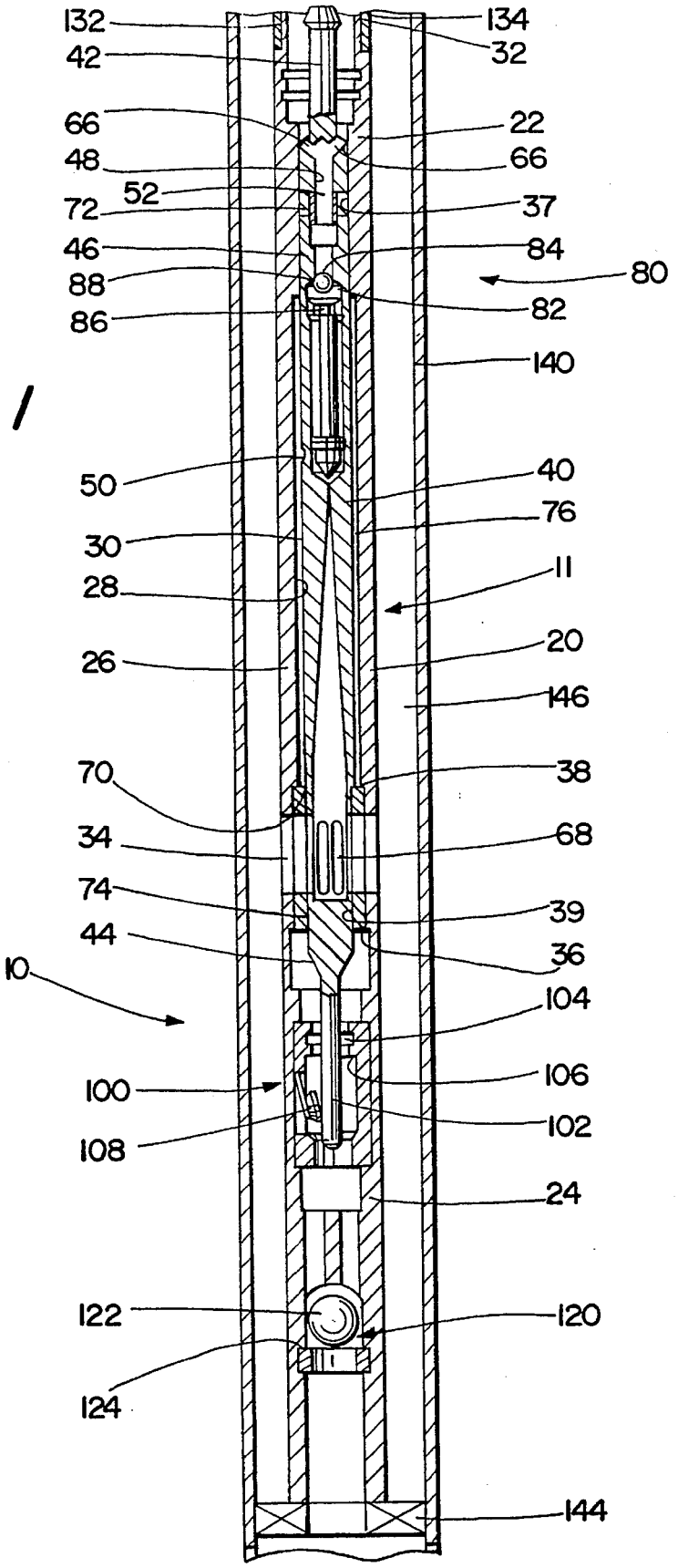
FIG. 1 is a sectional, side elevational view of a free pumping apparatus operatively positioned in a producing well.
Figure 2:
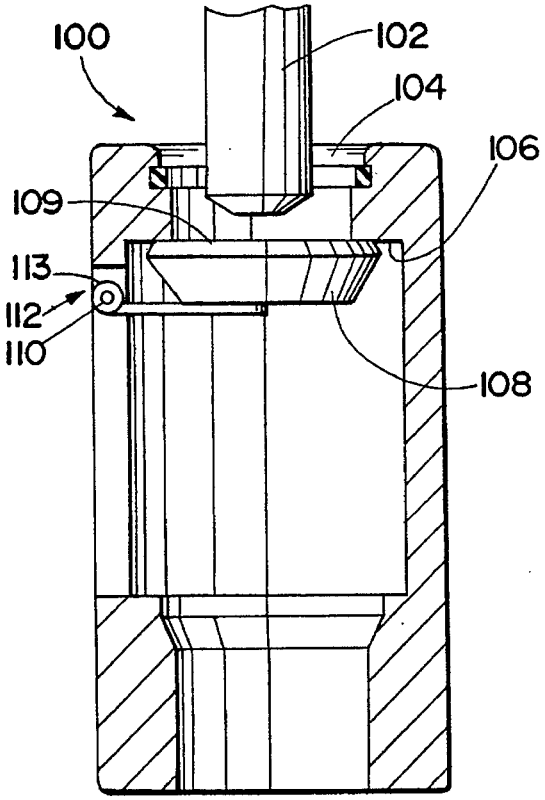
FIG. 2 is a partial sectional view of the safety valve with the pump body not fully inserted and the safety valve in a closed position.
Figure 3:
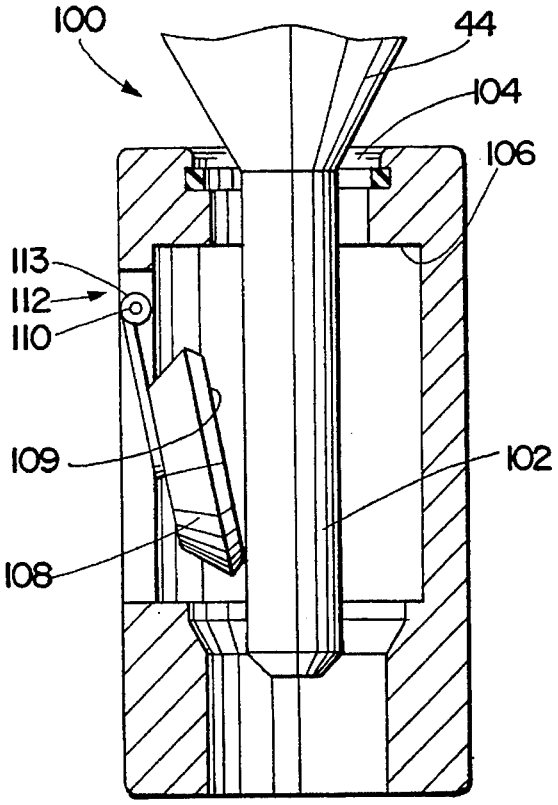
FIG. 3 is a partial sectional view of the safety valve with the pump body fully inserted and the safety valve in the open position.
Figure 4:
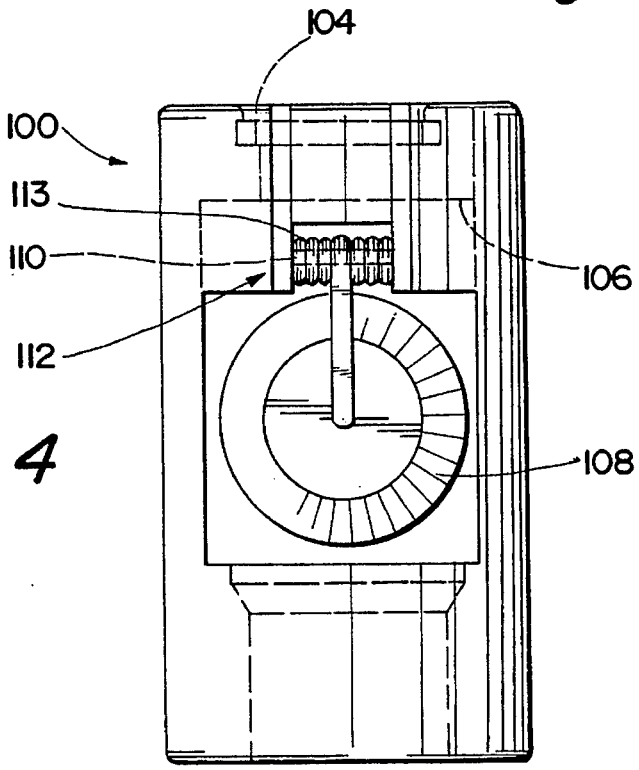
FIG. 4 is a side elevational view of the safety valve with the safety valve in the open position.
Figure 5:
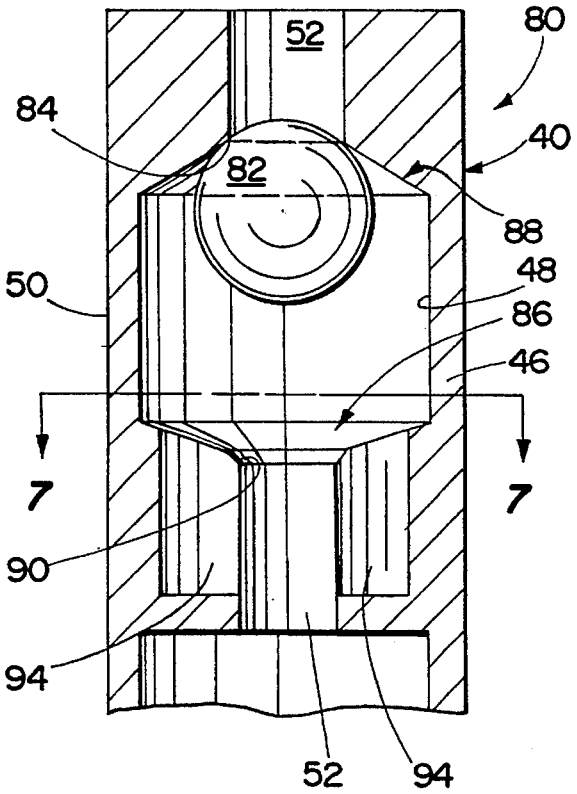
FIG. 5 is a partial sectional view of the check valve in the reverse flow closed position taken along broken section line 5—5 in FIG. 7.
Figure 6:
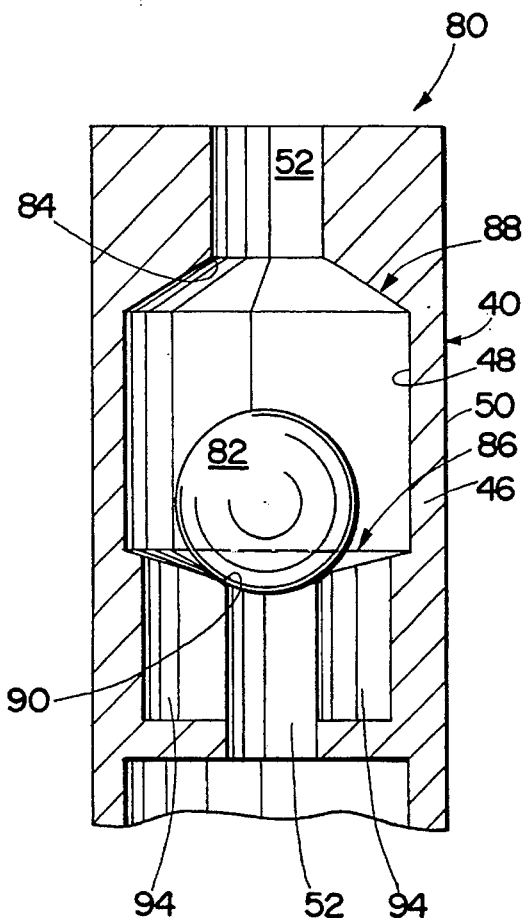
FIG. 6 is a partial sectional view of the check valve in the operative flow open position taken along broken section line 5—5 in FIG. 7.
Figure 7:
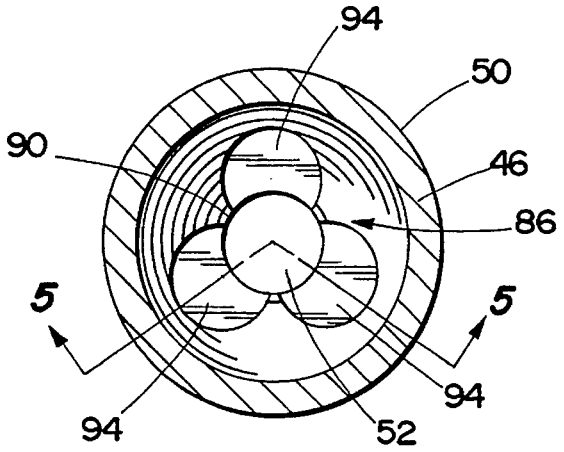
FIG. 7 is a cross sectional view of the valve ball engagement end of the check valve taken along section line 7—7 in FIG. 5.

Although the present invention may be applied to any well configuration, one example of a typical producing well is shown in FIG. 1 and is used throughout this description for illustration. In FIG. 1, a rigid, elongated, hollow well bore fluid communication conduit 140 extends into a formation fluid source and provides flow communication with the surface. At least one formation inlet within the well bore fluid communication conduit 140 permits formation fluids to flow into the well bore fluid communication conduit 140 for production. The formation fluid source is typically under pressure facilitating the flow of the formation fluids into the well bore fluid communication conduit 140.

An annular, hollow tubing 132 extends within the well bore fluid communication conduit 140 from the surface to a position below the formation fluid level. The tubing 132 may comprise any type of tubing including, inter alia, conventional and coil tubing. The free pumping apparatus 11 attaches to the tubing bottom end 134. A well bore fluid communication conduit seal 144 below the free pumping apparatus 11 and above the well bore fluid communication conduit formation inlets seals the formation fluid source from the area within the well bore fluid communication conduit 140 above the well bore fluid communication conduit seal 144. Because the tubing 132 has an outer diameter that is smaller than the inner diameter of the well bore fluid communication conduit 140, the well bore fluid communication conduit 140 and tubing 132 define an annular produced fluid passageway 146 above the well bore fluid communication conduit seal 144.

The free pumping apparatus 11 is made of two main separate parts, the pump housing 20 and the pump body 40. Generally, the pump housing 20 is fixedly attached to the tubing bottom end 134; and the pump body 40 slidably mates with the pump housing 20. Although FIG. 1 shows a jet-actuated free pumping apparatus 11 for illustrative purposes, the free pumping apparatus safety valve system 10 may be effectively applied to any type of free pumping apparatus including, inter alia, free jet pumps and free reciprocating pumps.

At the housing upper end 22, a housing attachment means connects the pump housing 20 to the tubing 132. The pump housing 20 has a housing wall 26 with an inner surface 28 that defines a longitudinal passageway 30 through the pump housing 20. This longitudinal passageway 30 provides flow communication between the pump housing 20 and the hollow tubing 132. Further, the longitudinal passageway 30 removably, slidably receives the pump body 40 to a predetermined fully-inserted position. A housing shoulder 38 sized and constructed to mate with and receive a pump body shoulder 70 stops the pump body's 40 downward movement and defines the fully-inserted position.

With the tubing 132 and the pump housing 20 installed in the well bore fluid communication conduit 140, power fluid is transmitted down through the hollow tubing 132, out of the pump housing 20 through at least one housing produced fluid outlet 34, and back up to the surface through the annular produced fluid passageway 146. To facilitate placement of the pump body 40 in the pump housing 20, the pump body 40 is constructed and sized to permit the pump body 40 to travel through the hollow tubing 132 and into the pump housing 20. When placed in the tubing 132 with the pressure of the power fluid to carry it, the pump body 40 slides through the tubing 132 and into the pump housing 20. Once positioned in the pump housing 20 in the fully-inserted position, the pressure supplied by the power fluid exerts a downward force on the pump body 40 and maintains the pump body 40 in position.

The outer diameter of the pump body 40 is smaller than the inner diameter of the housing longitudinal passageway 30. An upper seal 72, attached proximal a pump body upper end 42, and a lower seal 74, attached proximal a pump body lower end 44, engage corresponding housing sealing surfaces, namely the upper housing sealing surface 37 and the lower housing sealing surface 39. Thus, the housing wall inner surface 28 and the pump body wall 46 outer surface 50 form an annular formation fluid passageway 76 between the upper seal 72 and the lower seal 74. A housing formation fluid passageway 36 provides flow communication between the formation fluid source and the annular formation fluid passageway 76.

The pump body 40 has a longitudinal pump body cavity 52 therein. At least one power fluid inlet 66 in the pump body upper end 42 provides flow communication to the pump body cavity 52. During operation, power fluid from the surface, travels down through the tubing 132, through the power fluid inlet 66 and into the pump body cavity 52. Using the energy of the power fluid the free pumping apparatus 11 pumps produced fluid to the surface.

As noted, the power fluid not only serves to operate the free pumping apparatus 11 but also to exert a downward force on the pump body 40 and maintain the pump body 40 in position. The formation fluid source is generally under pressure and exerts an upward force on the pump body 40. Consequently, if the power fluid source is interrupted or the downward force exerted on the pump body 40 is too small, the upward force of the formation fluid unseats the pump body 40 from its fully-inserted position in the pump housing 20. When the pump body 40 is unseated, the free pumping apparatus 11 can no longer operate. Without the safety valve means 100 of the present invention, the formation fluid is then free to flow up through the tubing 132 and the well bore fluid communication conduit 140 and out through any break therein into the environment.

A valve means 100 proximal the housing lower end 24 selectively permits flow of formation fluid therethrough. A valve opening 104 of the valve means 100 provides flow communication therethrough. Disposed about the valve opening 104, a valve seat 106 mates with a valve plate 108. A valve plate hinge 110 rotatably connects the valve plate 108 to the pump housing 20. Thus, the valve plate 108 may selectively rotate into sealing abutment with the valve seat 106 and, thereby, close the valve opening 104. Alternatively, the valve plate 108 may rotate away from the valve seat 106 and, thereby open the valve opening 104. A valve plate biasing means 112 biases the valve plate 108 to the sealing, closed position. Preferably, the biasing means 112 comprises a torsion spring 113.

The purpose of the valve means 100 is to prevent the formation fluids from flowing into the pump housing (hereinafter referred to as reverse flow of formation fluid) when the pump body 40 is not in its fully-inserted position. Therefore, the valve seat 106 faces downward and engages the valve plate upper surface 109.

Attached to the pump body lower end 44, an elongated plunger 102 extends in axial alignment therefrom. When the pump body 40 is in the fully-inserted position, the plunger 102 engages the valve plate upper surface 109 and forces the valve plate 108 from the valve seat 106 into an open position. Thus, if the pump body 40 is forced from its fully-inserted position (e.g. due to a loss of power fluid pressure and resultant reverse flow of formation fluid) the plunger 102 moves away from the valve plate 108. With the force of the plunger 102 removed from the valve plate 108, the valve plate biasing means 112 forces the valve plate 108 to the closed position. In this way, the valve plate 108 prevents reverse flow of formation fluid through the valve opening 104 when the pump body is not in the fully-inserted position. Other applicable instances when the valve plate 108 seals the valve opening 104 include before insertion of the pump body 40 and after reverse circulation of the pump body 40 from the pump housing 20.

Functionally applying the above described free pumping apparatus safety valve system 10 is a method of providing a safety shut-off valve to prevent the escape of formation fluids from a damaged well.

Reverse circulation of the pump body 40 provides an economical way to maintain the parts of the pump body 40 most susceptible to wear. Generally, reverse circulation of the pump body 40 involves circulating power fluid down through the annular produced fluid passageway 146 and into the pump body cavity 52. In the pump body cavity 52, the pressure supplied by the power fluid acts on the pump body wall inner surface 48 to force the pump body 40 from the pump housing 20 and up through the tubing 132 to the surface.

Accordingly, in both reverse circulation of the pump body 40 from the pump housing 20 and in removal of the pump body 40 from the fully-inserted position due to reverse flow of formation fluid situations, the relevant fluids act on the pump body wall inner surface 48. To prevent waste of energy and resources and to provide a more responsive valve means 100, the preferred embodiment includes a check valve means 80 within the pump body cavity 52 of the pump body 40.

Generally, the check valve means 80 comprises a valve ball 82, a check valve seat 84, and a flow-through valve ball holder 86. A portion of the pump body cavity 52 contains the valve ball 82 therein. To facilitate movement of the valve ball 82 within the valve ball containing portion of the pump body cavity 52 and downstream flow of power fluid around the valve ball 82, the diameter of the valve ball 82 is smaller than the inner diameter of the valve ball containing portion of the pump body cavity 52.

Above the valve ball containing portion of the pump body cavity 52, a valve seat 84 sealingly mates with the valve ball 82 during reverse flow situations. Preferably, the valve seat 84 comprises a frustoconical shaped portion 88 of the pump body cavity 52. The smallest diameter of the frustoconical shaped portion 88 is sized and constructed to permit the downstream flow of power fluid therethrough. However, the smallest diameter of the frustoconical shaped portion 88 is smaller than the outer diameter of the valve ball 82. Additionally, the diameter of the frustoconical shaped portion increases in the downstream direction and, thereby, facilitates receipt of the valve ball 82 during reverse flow situations.

Below the valve ball containing portion of the pump body cavity 52, a flow-through valve ball holder 86 receives the valve ball 82 during operative fluid production flow, i.e. downstream flow of power fluid. While holding the valve ball 82 during operative fluid production flow, the flow-through valve ball holder 86 permits flow therethrough. Preferably, the flow-through valve ball holder 86 has one end, the valve ball engagement end 90, that receives and mates with the valve ball 82 during operative fluid production flow. At least one communication passageway 94 facilitates flow communication between the valve ball engagement end 90 and a distal lower end 92 positioned downstream of the valve ball engagement end 90.

Thus, during operative fluid production flow, the valve ball mates with the valve ball engagement end 90 of the flow-through valve ball holder 86. The power fluid flows around the valve ball, through the communication passageways 94, to the distal lower end 92, and into the lower portion of the pump body cavity 52.

However, if the flow is reversed or if the formation fluid flows upward through the pump body cavity 52, the valve ball 82 moves upward and engages the check valve seat 84. The reverse flow through the power fluid cavity 58 then acts not only on the pump body wall inner surface 48 but on the valve ball 82 as well. Consequently, the reverse flow has a greater area on which to act and force the pump body 40 upward. As a result, the reaction of the pump body 40 to the reverse flow is more responsive and more efficient. Providing a pump body 40 that is more responsive to reverse flow creates a valve means 100 that is more responsive to reverse flow, thereby, better limiting the escape and waste of formation fluids.

Functionally applying the above described free pumping apparatus safety valve system 10 including the check valve means 80 is a more responsive method providing a safety shut-off valve to prevent the escape of formation fluids from a damaged well. Additionally, functionally applying the check valve means 80 provides a method of improved reverse circulation of a free pumping apparatus 11 from a producing well.

I claim:

1. A free pumping apparatus safety valve system for use in producing a formation fluid source comprising:

a pump housing having a housing upper end and a housing lower end;

a longitudinal passageway through said housing;

an attachment means for connecting said pump housing to a bottom end of a tubing;

a pump body having an upper end and a lower end;

said pump body removably, slidably positioned within said passageway;

a valve means for selectively permitting flow of formation fluid therethrough;

said valve means positioned within said pump housing passageway proximal said pump housing lower end;

a plunger connected to said pump body lower end; and said plunger constructed to selectively open and close said valve means.

2. A free pumping apparatus safety valve system for use in producing a formation fluid source as claimed in claim 1 wherein said valve means comprises:

a valve opening;

a valve seat disposed about said valve opening;

a valve plate positioned and constructed to selectively, sealingly mate with said valve seat and close said opening;

a hinge rotatably connecting said valve plate to said pump housing; and a biasing means for biasing said valve plate to sealingly close said valve opening.

3. A free pumping apparatus safety valve system for use in producing a formation fluid source as claimed in claim 2 wherein:

said pump housing passageway constructed to receive said pump body to a predetermined fully-inserted position; and said plunger constructed to force said valve plate off said valve seat when said pump body is in said fully-inserted position thereby opening said valve means.

4. A free pumping apparatus safety valve system for use in producing a formation fluid source as claimed in claim 1 further comprising a standing valve positioned in said passageway proximal said pump housing lower end.

5. A method of providing a safety shut-off valve to prevent escape of well fluid from a damaged producing well comprising functionally applying said free pumping apparatus safety valve system for use in producing a formation fluid source according to claim 1 to a tubing of a producing well.

6. A free pumping apparatus safety valve system for use in producing a formation fluid source as claimed in claim 1 further comprising:

a cavity in said pump body;

at least one power fluid inlet in said pump body upper end to provide flow communication between said cavity and a longitudinal cavity in said tubing;

a check valve means for selectively permitting flow through said at least one power fluid inlet and said pump body cavity;

said check valve means constructed to permit flow through said at least one power fluid inlet and said cavity during operative fluid production flow; and said check valve means constructed to restrict flow through said at least one power fluid inlet and said cavity during reverse circulating flow.

7. A method of providing a safety shut-off valve to prevent escape of well fluid from a damaged producing well comprising functionally applying said free pumping apparatus safety valve system for use in producing a formation fluid source according to claim 6 to a tubing of a producing well.

8. A free pumping apparatus safety valve system for use in producing a formation fluid source comprising:

a pump housing having a housing upper end and a housing lower end;

a longitudinal passageway through said housing;

an attachment means for connecting said pump housing to a bottom end of a tubing;

a pump body having an upper end and a lower end;

said pump body removably, slidably positioned within said passageway;

a cavity in said pump body;

at least one power fluid inlet in said pump body upper end to provide flow communication between said cavity and a longitudinal cavity in said tubing;

a check valve means for selectively permitting flow through said at least one power fluid inlet and said pump body cavity;

said check valve means constructed to permit flow through said at least one power fluid inlet and said cavity during operative fluid production flow; and said check valve means constructed to restrict flow through said at least one power fluid inlet and said cavity during reverse circulating flow.

9. A free pumping apparatus safety valve system for use in producing a formation fluid source as claimed in claim 8 wherein said check valve means comprises:

a valve ball positioned in said pump body cavity;

a check valve seat in said pump body cavity constructed to sealingly mate with said valve ball during reverse circulating flow;

a flow-through valve ball holder in said pump body cavity constructed to receive said valve ball during operative fluid production flow; and said flow-through valve ball holder constructed to permit flow therethrough when engaged with said valve ball.

10. A free pumping apparatus safety valve system for use in producing a formation fluid source as claimed in claim 9 wherein said check valve seat comprises:

a frustoconical shaped portion of said pump body cavity;

said frustoconical shaped portion diameter increasing in a downstream direction; and said frustoconical shaped portion having a smaller diameter end diameter that is smaller than said ball diameter.

11. A free pumping apparatus safety valve system for use in producing a formation fluid source as claimed in claim 9 wherein said flow-through valve ball holder comprises:

a valve ball engagement end designed to receive and mate with said valve ball;

a distal lower end downstream of said valve ball engagement end; and at least one communication passageway formed in said pump body cavity providing flow communication between said valve ball engagement end and said lower end.

12. A free pumping apparatus safety valve system for use in producing a formation fluid source as claimed in claim 8 further comprising a standing valve positioned in said passageway proximal said pump housing lower end.

13. A method of improved reverse circulation of a free pumping apparatus safety valve system for use in producing a formation fluid source pump body from an apparatus housing and through a connected tubing comprising:

functionally applying said free pumping apparatus according to claim 8 to a tubing;

providing a well bore fluid communication conduit disposed about said tubing; and reverse circulating a fluid downwardly through a well bore fluid communication conduit and upwardly through said tubing.

* * * * *